United States Patent [19]

Owen

[11] Patent Number: 4,514,602

[45] Date of Patent: Apr. 30, 1985

[54] SWITCHING APPARATUS

[76] Inventor: Donald W. Owen, 4619 Ridgeline Dr., Norman, Okla. 73069

[21] Appl. No.: 453,728

[22] Filed: Dec. 27, 1982

[51] Int. Cl.[3] ..... H01H 15/00; H01H 3/32

[52] U.S. Cl. ..... 200/16 C; 200/17 R

[58] Field of Search ..... 200/1 R, 5 R, 11 TC, 200/16 C, 16 D, 17 R, 18, 14

[56] References Cited

U.S. PATENT DOCUMENTS

| | | | |
|---|---|---|---|
| 726,391 | 4/1903 | Armstrong et al. | 323/340 |
| 1,291,078 | 1/1919 | Moody | 323/346 |
| 1,632,097 | 6/1927 | Peters | 336/150 |
| 1,993,794 | 3/1935 | Meyerhans | 336/119 |
| 2,464,061 | 3/1949 | Soley, Jr. | 324/115 |
| 2,487,199 | 11/1949 | Titcomb | 200/16 C |
| 2,590,274 | 3/1952 | Rourke | 200/16 C |
| 2,796,473 | 6/1957 | Davis | 200/16 C |
| 3,083,331 | 3/1963 | Spurway | 323/346 |
| 3,182,248 | 5/1965 | McNamee | 336/145 |
| 3,299,226 | 1/1967 | Edwards | 200/16 C |
| 3,349,320 | 10/1967 | Mathes | 323/340 |
| 3,484,727 | 12/1969 | Weber et al. | 336/147 |
| 3,619,764 | 11/1971 | Brennan | 323/341 |
| 3,670,117 | 6/1972 | Yancey | 200/16 C |
| 3,725,833 | 4/1973 | Thomas | 336/146 |
| 3,824,355 | 7/1974 | Norman et al. | 200/16 C X |
| 4,160,224 | 7/1979 | Owen | 336/147 |
| 4,255,734 | 3/1981 | Owen | 336/147 |
| 4,256,932 | 3/1981 | Owen | 200/11 TC |

*Primary Examiner*—J. R. Scott

*Attorney, Agent, or Firm*—E. Harrison Gilbert, III

[57] ABSTRACT

A switching apparatus includes a support member having a plurality of connector terminals linearly arrayed along a side thereof. A common electrically conductive terminal is disposed in parallel relationship with the linearly arrayed connector terminals. The common terminal is spaced from the connector terminals so that a plurality of open areas are defined for receiving a connector member which is moved by a movement mechanism to connect a selected one of the connector terminals to the common terminal. The connector element is so disposed that the making and breaking of its engagement with the connector terminals is offset from the line along which the connector terminals are arrayed so that electrically conductive bridges are not formed between electrical conductors connected to adjacent ones of the connector terminals.

14 Claims, 12 Drawing Figures

SWITCHING APPARATUS

BACKGROUND OF THE INVENTION

This invention relates generally to switching apparatus of the type used in electrical transformers, for example, and more particularly, but not by way of limitation, to a compound tandem switching apparatus for interconnecting selectable ones of a plurality of tapped sections of a plurality of windings of a transformer.

It is, of course, well known that electrical transformers include primary and secondary windings which can have tapped sections which are selectably interconnectable so that different outputs can be obtained from the transformer. An example of such a transformer is shown in U.S. Pat. No. 4,160,224 in the name of Owen. The selectable interconnections are often made by a manual switching apparatus, one example of which is also illustrated in U.S. Pat. No. 4,160,224. Exemplary switching apparatus is claimed in U.S. Pat. No. 4,256,932, also in the name of Owen.

Such manual switching apparatus have been of the rotary type wherein a circular array of terminals are switchably connectable to a common terminal by a rotatable wiper arm which makes and breaks contact with the terminals along the same line or path on which the terminals are disposed. The wiper arm of such a switch is turned either by a rotary motion as exemplified in U.S. Pat. No. 4,160,224 or by a linear motion as believed to be exemplified in U.S. Pat. No. 726,391 in the name of Armstrong et al.

Although such prior art switching apparatus are functional, they do have certain disadvantages. For examle, such a rotary switching apparatus often requires substantial space which necessitates the use of a larger container in which the transformer is to be retained. This requirement for substantial space is brought about by, for example, the curvilinear disposition of the terminals, the allowance of space for making the lead connections to the terminals, and the size of the rotary mechanism. Therefore, there is a need for a more streamlined switching apparatus which does not require as much space, at least in one dimension, as such prior rotary types.

Such larger prior switching apparatus also require relatively long leads from the tapped sections to the switch terminals. Because a longer lead of a given diameter and material has a greater resistance than a shorter lead of the same diameter and material, there is a greater loss when the longer lead is used. Therefore, there is also the need for a switching apparatus which permits the use of a reduced lead length, thereby reducing electrical losses.

Such prior art switching apparatus also can be constructed so that the leads from the transformer windings to the connection terminals must be criss-crossed or so that leads between terminals of the switching apparatus must be criss-crossed. Such criss-crossing makes the connections more difficult to make; therefore, there is the need for a new switchig apparatus which enables a simplified lead connection array.

Furthermore, in these prior switching apparatus wherein the path of the portion of the wiper arm which makes contact with the terminals is along the line on which the terminals are disposed, there is the tendency during use thereof for the wiper arm to remove a portion of the conductive material of which the terminals are formed and to drag the removed material along the line toward the next terminal as the wiper arm is moved from one terminal to the next. It is apparent that after extended use of such an apparatus, the removed material can create an electrically conductive path between the adjacent terminals, thereby creating a short-circuit and a potential safety hazard. Thus, there is the need for a switching apparatus which does not tend to construct such a conductive bridge between adjacent terminals.

SUMMARY OF THE INVENTION

The present invention overcomes the above-noted and other shortcomings of the prior art by providing a novel and improved switching apparatus. This apparatus is relatively compact so that it can be used in a relatively small space. The present invention is also constructed so that when it is used with a transformer, shorter leads from the transformer tapped sections to the invention can be used. Additionally, the terminals of the invention are so disposed that the connection of the leads to the terminals and the connection of electrical conductors between terminals of the switching apparatus are facilitated. Still further, the present invention provides a wiper mechanism which does not tend to construct an electrically conductive path between adjacent terminals as the wiper mechanism is moved therebetween.

Broadly, the present invention provides a switch comprising support means including a plurality of contact terminal means for receiving electrical conductors. The plurality of contact terminal means are disposed substantially linearly along the support means.

The switch further comprises a common terminal means which is associated with the support means. The common terminal means is connectable to each of the plurality of contact terminal means. More particularly, the common terminal means is disposed on the support means in spaced relation to the plurality of contact terminal means so that a plurality of areas are defined. Each of the areas is defined between a respective one of the contact terminal means and a respective portion of the common terminal means. Additionally, each of the areas is spaced from each adjacent one of the areas.

The switch still further comprises connector means for selectively electrically connecting each of the plurality of contact terminal means with the common terminal means. More particularly, the connector means is disposed for movement along a path that includes the plurality of areas so that the connector means electrically connects the respective one of the contact terminal means and the respective portion of the common terminal means when the connector means is moved adjacent one of the areas and further so that the connector means does not electrically connect any one of the contact terminal means with any other of the contact terminal means, or with the common terminal means for the embodiments illustrated herein, when the connector means is moved to a position between adjacent ones of the areas.

The switch also includes movement means for moving the connector means to electrically connect a selected one of the plurality of contact terminal means with the common terminal means. The movement means more particularly includes means for converting rotary motion into linear motion and means for coupling the linear motion to the connector means.

In a preferred embodiment the present invention provides a compound tandem switching apparatus for interconnecting selectable ones of a plurality of tapped sections of a plurality of windings of a transformer. However, it is to be noted that the present invention is not limited to its particularly described use with a transformer.

Therefore, from the foregoing it is a general object of the present invention to provide a novel and improved switching apparatus. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 6 is a sectional end elevational view of the first preferred embodiment taken along line 6—6 shown in FIG. 4, but omitting the sprocket wheels and chain.

FIG. 7 is a partial sectional plan view of the first preferred embodiment taken along line 7—7 shown in FIG. 4.

FIG. 9 is a top plan view of a second preferred embodiment of the present invention.

DETAILED DESCRIPTION OF THE PREFERRED EMBODIMENTS

Figure 1:
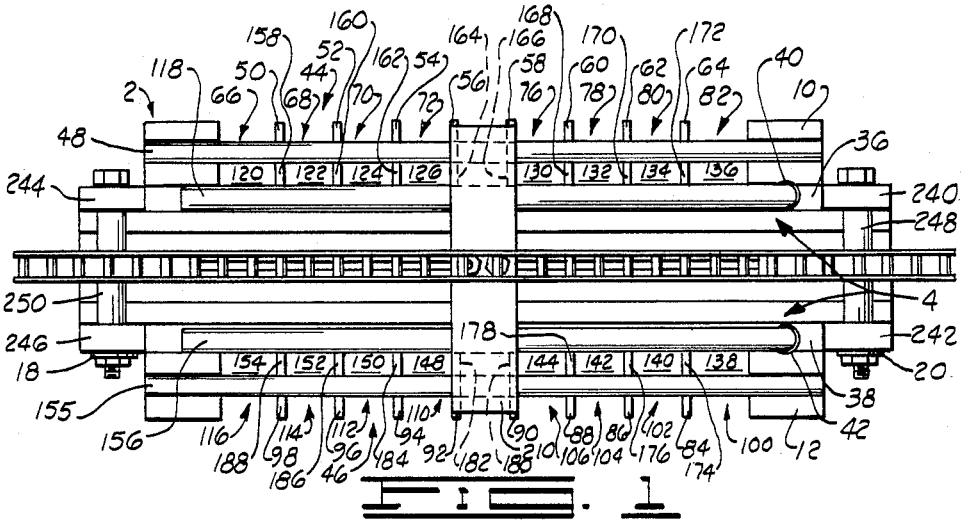
FIG. 1 is a top plan view of a first preferred embodiment of the present invention.
Figure 2:
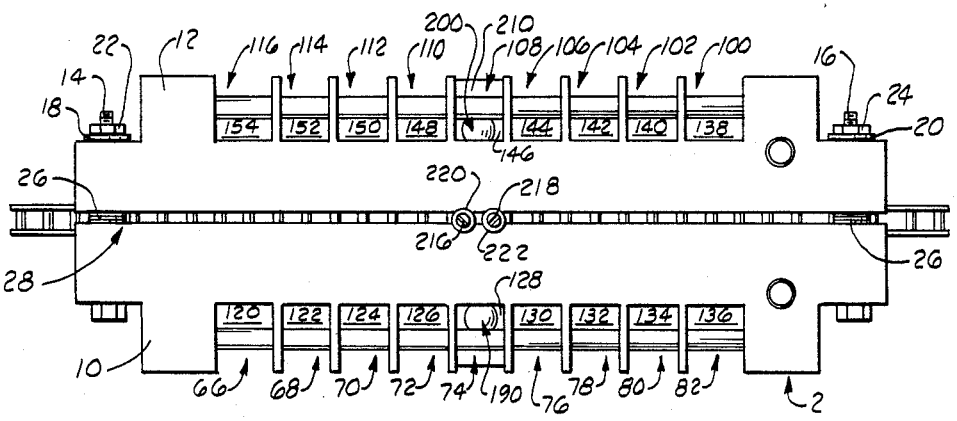
FIG. 2 is a bottom plan view of the first preferred embodiment.
Figure 3:
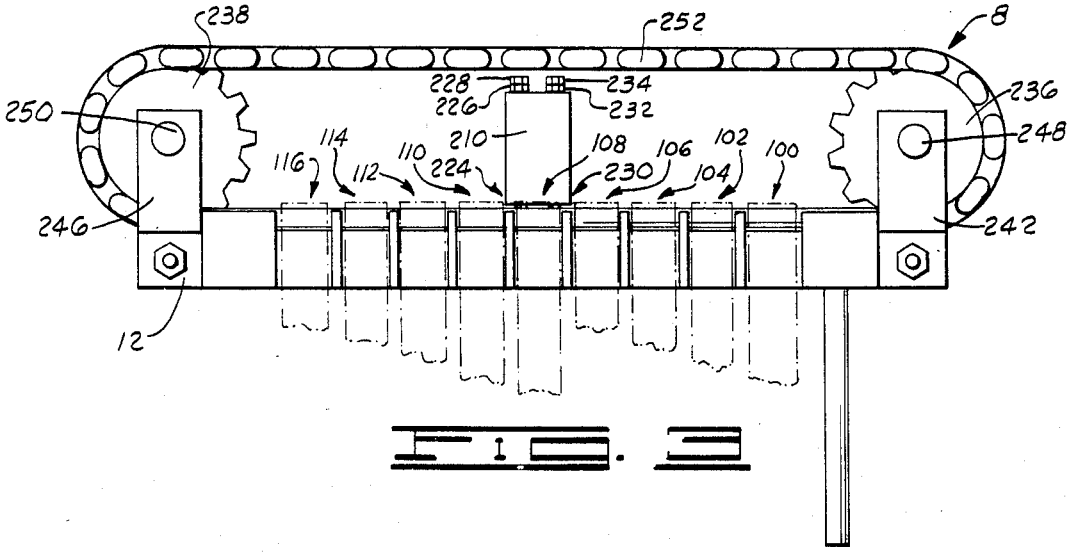
FIG. 3 is a first side elevational view of the first preferred embodiment.

With reference to FIGS. 1–7, a first preferred embodiment of a switching apparatus constructed in accordance with the present invention will be described. The first preferred embodiment switching apparatus broadly includes a support means 2, common terminal means 4, connector means 6 (see FIG. 6), and movement means 8.

The support means 2 of the first preferred embodiment includes a first wooden member 10 connected to a second wooden member 12 by means of bolts 14, 16 passing through respective holes in the members 10, 12 and fastened by spring lock washers 18, 20, respectively, and nuts 22, 24, respectively. The first member 10 is spaced from the second member 12 by means of spacer elements 26 so that a slot 28 is defined between the members 10, 12.

Each of the members 10, 12 has an L-shaped groove 30, 32, respectively, cut therein, which grooves face each other when the members 10, 12 are joined, thereby defining a channel 34 extending along the length of the support means 2. Each of the members 10, 12 also has second grooves 36, 38, respectively, cut therein. The grooves 36, 38 extend parallel to the grooves 30, 32 and thus to the channel 34. Each groove 36, 38 has a hole passing therefrom through the respective member 10, 12 to the bottom surface of the members 10, 12. These holes are designated by the reference numerals 40, 42, respectively. It is to be noted that the words "top" and "bottom" as used herein are for purposes of describing the embodiments as illustrated in the drawings; these words are not to be taken as limiting the invention or the manner in which it can be disposed in a specific type of usage.

The support means 2 further includes a plurality of contact terminal means shown in FIG. 1 to particularly include in the preferred embodiment a first plurality of connector terminals 44 and a second plurality of connector terminals 46. For the preferred embodiment shown in FIGS. 1–7, the first plurality of connector terminals 44 is linearly disposed along one side of the support means 2 and the second plurality of connector terminals 46 is linearly disposed along a second side of the support means 2 whereby the second plurality of connector terminals is in parallel relationship with the first plurality of connector terminals. Each of the connector terminals is constructed for receiving an electrical conductor. In the preferred embodiment, the electrical conductors which are attached or otherwise associated with the connector terminals define discrete tap changing contacts.

In the preferred embodiment the first plurality of connector terminals 44 is defined by a non-conductive terminal rod 48 secured at its ends to respective mounting portions of the support means 2. In the preferred embodiment such mounting is accomplished by gluing the ends into complementally shaped grooves formed in the support means 2.

The various connector terminals of the first plurality are defined along the terminal rod 48 by means of a plurality of walls 50, 52, 54, 56, 58, 60, 62, and 64 disposed at spaced intervals along the first side of the support means 2. Such a construction incorporating the walls 50-64 gives the support means 2 a "toothed" appearance with each of the walls representing a single tooth. Each connector terminal is defined between the facing surfaces of each set of two walls with the outermost two connector terminals being defined between the facing surfaces of the wall 50 and one of the mounting portions of the support means 2 and between the facing surfaces of the wall 64 and the other one of the mounting portions of the support means 2. The connector terminals so defined are designated by the reference numerals 66, 68, 70, 72, 74, 76, 78, 80 and 82.

Figure 4:
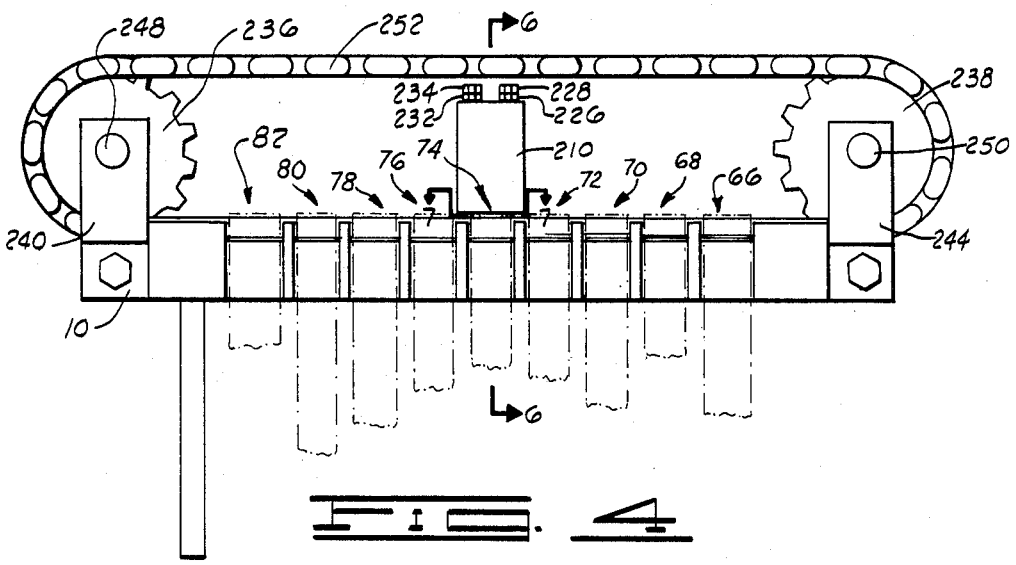
FIG. 4 is a second side elevational view of the first preferred embodiment.
Figure 5:
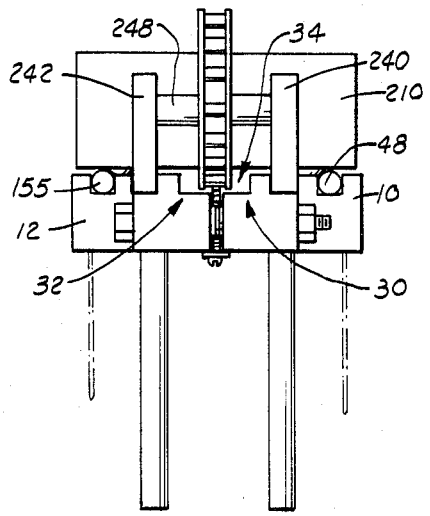
FIG. 5 is an end elevational view of the first preferred embodiment.
Figure 5:
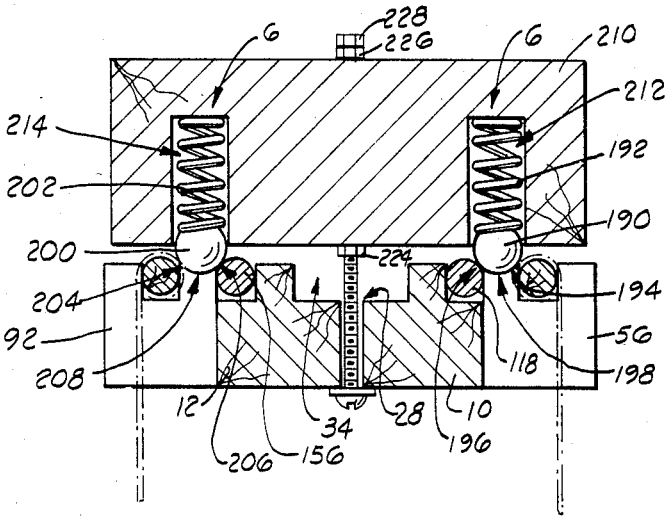
Figure 1:
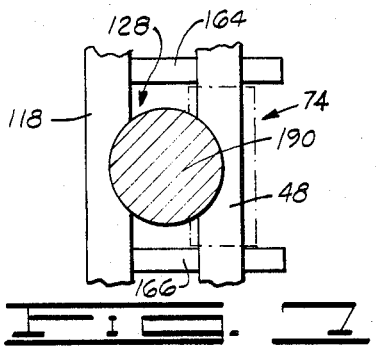
Figure 2:
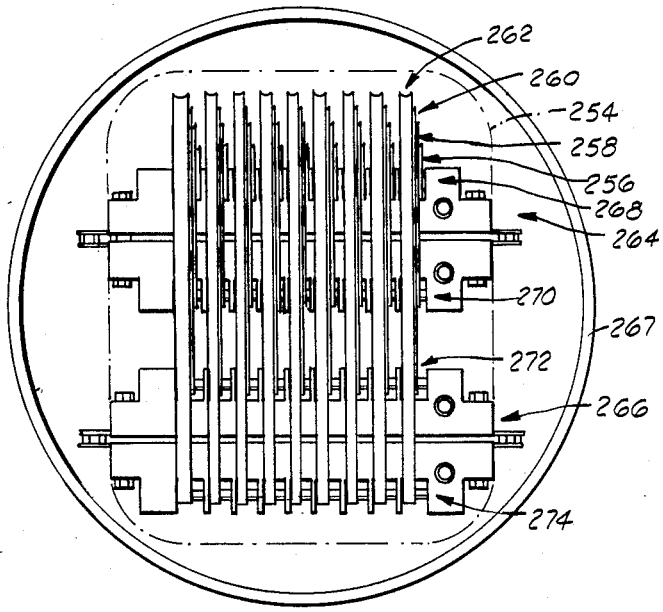
Figure 3:
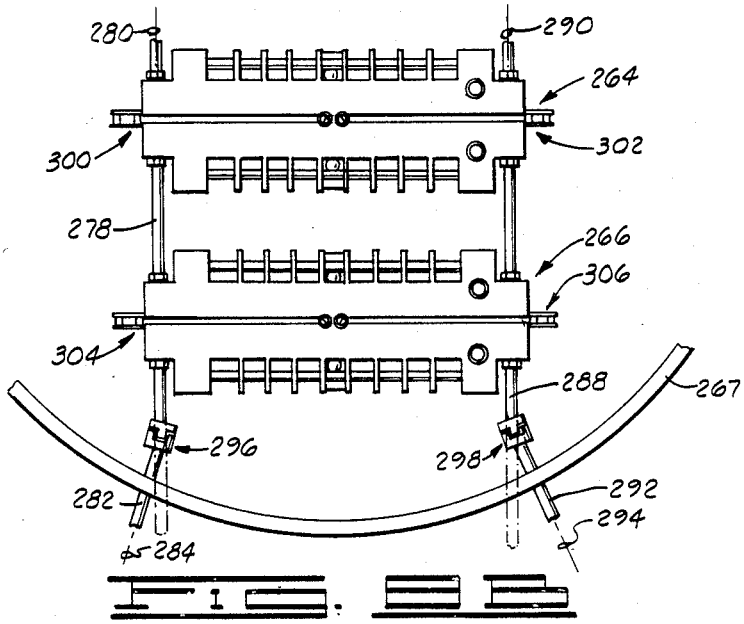

As shown in phantom in FIG. 4, for example, electrical conductors are connectable to the connector terminals 66–82 such as by wrapping an end of a flat electrical conductor over a respective one of the terminals and then crimping or otherwise securing the conductor thereto.

Upon examining the drawings it will be apparent that the second plurality of connector terminals 46 of the preferred embodiment is constructed substantially identically to the first plurality of connector terminals. However, in the preferred embodiment the disposition of the linearly disposed connector terminals of the second plurality are in reverse order with respect to the disposition of the connector terminals of the first plurality. Because of the similarity, no further description will be given other than to identify each of the walls associated with the second plurality by the reference numerals 84, 86, 88, 90, 92, 94, 96 and 98 and to designate the respective terminals by the reference numerals 100, 102, 104, 106, 108, 110, 112, 114 and 116.

It is to be noted that the connector terminals of the first and second pluralities are aligned on opposite sides of the support means 2. In the preferred embodiment shown in FIGS. 1–7, this alignment is defined by having each opposite pair of connector terminals (e.g., terminals 82 and 100) disposed on a line extending substantially perpendicularly to the slot 28 or to the direction of the linear disposition of each of the first and second pluralities of connector terminals.

It is also to be noted that in the preferred embodiment the top of the terminal rod 48 and its counterpart in the second plurality of connector terminals are disposed in relation with the walls 50–64 and the walls 84–98 for the terminal rod of the second plurality of connector terminals so that the electrical conductors which are to be connected to the terminal rods are sufficiently above the upper surfaces of the walls to achieve a sufficient electrical contact with the connector means as will be more fully described hereinbelow.

The support means 2 further includes a first plurality of connector receiving means for receiving the connector means 6 in electrical communication with the first plurality of connector terminals 44 and a first common terminal 118 of the common terminal means 4. In the preferred embodiment each of the first plurality of connector receiving means includes a respective area of depression defined at the mouth of an opening passing through the member 10. Each area of depression is defined between a respective one of the first plurality of connector terminals 44 and a respective portion of the first common terminal 118 and between adjacent ones of the walls 50-64 or the outermost walls 50 and 54 and the adjacent terminal rod mounting portions of the member 10. As shown in the drawings, these areas of depression, or connector receiving means, are identified by the reference numerals 120, 122, 124, 126, 128, 130, 132, 134, and 136.

The support means also includes a second plurality of connector receiving means similar to the first plurality of connector receiving means. This second plurality includes areas of depression at the mouths of openings defined through the second member 12. These areas are identified in the drawings by the reference numerals 138, 140, 142, 144, 146, 148, 150, 152, and 154. These areas are defined between a terminal rod 155 of the second plurality of connector terminals and a second common terminal 156 of the common terminal means 4 and between respective ones of the walls 84–98 and the respective mounting portions of the member 12 used for retaining the terminal rod 155 of the second plurality of connector terminals 46.

The support means 2 still further includes a first plurality of connector engaging means for engaging the connector means 6 and moving the connector means 6 out of electrical communication with the first plurality of connector terminals 44 and the first common terminal 118. These connector engaging means are defined in the preferred embodiment by respective portions of the walls 50–64, which respective portions are disposed between a respective adjacent pair of the first plurality of connector receiving means including the previously identified areas of depression 120–136. The first plurality of connector engaging means are identified in the preferred embodiment shown in FIGS. 1–7 by the reference numerals 158, 160, 162, 164, 166, 168, 170 and 172. It is to be noted that each of the connector engaging means is offset from the first plurality of connector terminals 44 so that when the connector means 6 engages one of the first connector engaging means, the connector means 6 is moved away from the first plurality of connector terminals 44 and the first common terminal 118 whereby no electrical path is provided between the first plurality of connector terminals 44 and the first common terminal 118 or between adjacent ones of the first plurality of connector terminals 44. This offset disposition precludes the possible development of an electrically conductive bridge between adjacent ones of the terminals 66–82. As previously noted, the walls which define the plurality of connector engaging means also have the surfaces which define the side boundaries of the areas 120–136.

The support means 2 also includes a second plurality of connector engaging means associated with the second plurality of connector terminals in a manner similar to that in which the first plurality of connector engaging means are constructed and associated with the first plurality of connector terminals 44. The second plurality of connector engaging means are defined by portions of the walls 84–98 as identified by the reference numerals 174, 176, 178, 180, 182, 184, 186, and 188.

The common terminal means 4 includes the aforementioned first common terminal 118 and the second common terminal 156. In the preferred embodiment the first common terminal 118 and the second common terminal 156 each includes an elongated electrical conductor extending parallel to its respective plurality of connector terminals. As shown in the drawings, each of the elongated electrical conductors has a circular cross-section and is mounted in a respective one of the grooves 36, 38. Each of the elongated electrical conductors has a substantially right angle bend in it so that a leg of the elongated electrical conductor is defined. Such leg passes through the hole 40 or 42 as illustrated. These legs of the electrical conductors are for coupling with selected ones of the connector terminals or leads. Each of the elongated electrical conductors is retained in its respective groove by a suitable means, such as by gluing in the preferred embodiment. This disposition of the elongated member maintains it in spaced relation with respect to its associated plurality of connector terminals.

The connector means 6 is used for selectively electrically connecting each of the plurality of connector terminals with the associated common terminal. The connector means 6 is movable by the movement means 8 along a path including the aforementioned plurality of areas 120–136 and the portions 158–172 of the walls 50–64 and along a path including the areas 138–154 and the portions 174–188 of the walls 84–98. This movement occurs so that the connector means 6 electrically connects the respective connector terminal and the respective portion of the associated common terminal when the connector means 6 is moved adjacent one of the areas and further so that the connector means does not electrically connect any of the connector terminals with the associated common terminal or with other connector terminals when the connector means is moved to a position between adjacent ones of the areas, for example, to a position adjacent respective ones of the connector engaging means 158–172 and 174–188. It is not critical in the preferred embodiment that the connector means not touch the common terminal when the connector means is moved between adjacent ones of the areas; however, it is important that the connector means not simultaneously touch adjacent ones of the connector terminals because if such touching were to occur, the respective electrical conductors attached to such terminals would be short-circuited together which is not desirable when the electrical conductors are leads from sections of a transformer winding, for example.

In the preferred embodiment shown in FIGS. 1–7 the connector means 6 includes a first electrically conductive member 190 and a first biasing means 192 for biasing the first electrically conductive member 190 toward the path of travel defined by the first plurality of connector receiving means and the first plurality of connector engaging means. As shown in FIG. 6, the biasing means 192 includes a spring.

The first electrically conductive member 190 of the preferred embodiment is a spherical ball made of an electrically conductive material for providing an electrically conductive path between an electrical conductor connected to one of the connector terminals 66–82 and the first common terminal 118. The electrically conductive member 190 has a first portion 194, a second portion 196 and a third portion 198 as shown in FIG. 6. The first portion engages a respective one of the connector terminals and the second portion 196 engages a respective portion of the common terminal 118 when the third portion 198, which third portion 198 is disposed between the first portion 194 and the second portion 196, is disposed in a respective one of the areas of depression of the first plurality of connector receiving means. The third portion 198 is also used for contacting the wall portions 158–172 of the first plurality of connector engaging means so that the first and second portions 194, 196 are disengaged from the connector terminals and the common terminal when the first electrically conductive member 190 is moved between adjacent ones of the areas of depression. When the third portion engages a wall portion, the electrically conductive member 190 is urged against the biasing means 192. It is to be noted that this disposition of the electrically conductive member 190 and the wall portions 158–172 in an offset manner from the linear direction of the first plurality of connector terminals prevents the build-up of an electrically conductive bridge between electrical conductors connected to adjacent ones of the connector terminals 66–82.

The connector means 6 of the first preferred embodiment includes a second electrically conductive member 200 and a second biasing means 202 constructed and coactig in a manner similar to that described hereinabove with reference to the first electrically conductive member 190 and the first biasing means 192. As shown in FIG. 6, the second electrically conducting member 200 has a first portion 204, a second portion 206 and a third portion 208 disposed between the first and second portions 206, 208 for purposes similar to those described with reference to the portions 194–198 of the first electrically conductive member 190. The second electrically conductive member 200 is disposed for travel along the second path including the second plurality of connector receiving means and the second plurality of connector engaging means.

It is to be noted that because of the alignment of the two pluralities of connector terminals in the preferred embodiment and the manipulation of the movement means 8 as subsequently described, the first electrically conductive member 190 and the second electrically conductive member 200 are moved such that they make concurrent electrical contact with oppositely disposed ones of the first and second pluralities of connector terminals. For example, when the first electrically conductive member 190 engages the connector terminal 68, the second electrical conductive member 200 engages the terminal 114. This concurrent connecting of oppositely disposed ones of the connector terminals is achieved through the preferred embodiment of the movement means 8 which is used for moving the connector means 6 to electrically connect selected ones of the pluralities of connector terminals with the respective common terminals.

In the first preferred embodiment shown in FIGS. 1–7, the movement means 8 includes a housing 210 having a first opening 212 and a second opening 214 defined into the housing 210 through a surface thereof. The surface through which the openings 212, 214 are defined is disposed so that it faces the connector terminals and the common terminals. The first opening 212 has the first electrically conductive member 190 and the first biasing means 192 retained therein, and the second opening 214 has the second electrically conductive member 200 and the second biasing means 202 retained therein.

The movement means 8 also includes means for retaining the housing 210 in slidable engagement with the support means 2. In the first preferred embodiment, the retaining means includes two screws 216, 218 passing through the slot 28, the channel 34 and holes defined in the housing 210. The screws 216, 218 are secured by suitable means, such as washers 220, 222, respectively, and nuts 224–228, 230–234, respectively.

The movement means 8 further includes means for linearly moving the housing 210 along the support means 2 so that the first electrically conductive member 190 and the second electrically conductive member 200 concurrently engage consecutive ones of the first plurality 44 of connector terminals and the second plurality 46 of connector terminals, respectively, as the housing 210 is moved along the support means 2. In the preferred embodiment the linear moving means includes rotary motion conversion means for converting rotary motion into linear motion and means for coupling the linear motion to the housing 210. As shown in FIGS. 1–7, the rotary motion conversion means includes two sprocket wheels 236, 238 mounted at opposite ends of the support means 2 by suitable support struts 240–242 and 244–246, respectively. The sprocket wheels 236, 238 are rotatably mounted on the struts by shafts 248, 250, respectively. Each of the shafts 248, 250 has associated therewith a handle (see FIG. 8B) by means of which the shafts and associated sprocket wheels can be rotated. The rotary motion conversion means further includes a chain 252 mounted on the sprockets of the sprocket wheels.

The means for coupling the linear motion to the housing 210 includes in the first preferred embodiment portions of the screws 216, 218 used for retaining the housing 210 on the chain 252 in the channel 34 as illustrated in the drawings.

By turning the handle associated with the shaft 248 of the sprocket 236, it is apparent that the sprocket 236 will rotate thereby causing the chain 252 and sprocket 238 to also rotate. As the chain 252 rotates, it linearly drives the housing 210 along the length of the support means 2. As the housing 210 is driven, the first electrically conductive member 190 and the second electrically conductive member 200 move consecutively from one connector terminal to the next of the associated pluralities of connector terminals. As the first electrically conductive member 190 engages one of the wall portions 158–172, the electrically conductive member is urged against the biasing means 192 whereby the electrically conductive member is disengaged from its electrical connection between the respective connector terminal and the common terminal 118. Once the electrically conductive member 190 passes over the wall portion, it is snapped, or biased, into the next adjacent opening of the plurality of connector receiving means. This action provides a detent mechanism for the switch of the present invention. Similar movement of the second electrically conductive member 200 occurs concurrently with the aforementioned movement of the first electrically conductive member 190. Therefore, the first preferred embodiment illustrated in FIGS. 1–7 depicts a switching mechanism which can be used as a tandem switch to appropriately interconnect tapped windings of a transformer. Another such tandem switching mechanism can be constructed and used with the one shown in FIGS. 1–7 to provide a compound tandem switching apparatus of a type as schematically illustrated in FIGS. 8A and 8B.

Figure 8:
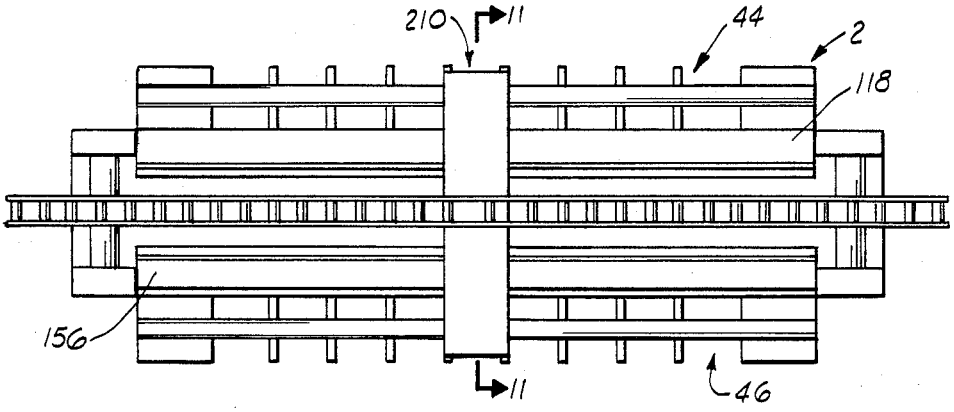
FIGS. 8A and 8B are schematic plan views of two of the first preferred embodiment switches in association with a transformer and a container of the transformer.

The compound tandem switching apparatus depicted in FIGS. 8A–8B is schematically shown in use with a transformer 254 having a plurality of windings with respective n numbers of leads 256, 258, 260 and 262 extending from tapped sections thereof. The compound tandem switching apparatus includes a first linear tandem switch 264 and a second linear tandem switch 266, each of which is constructed in accordance with the first preferred embodiment described hereinabove. These elements are contained in a suitable housing 267 of a type known to the art.

Each of the tandem switches 264, 266 has two pluralities of connector terminals, each of which plurality has an n number of terminals. Each of the n terminals is connectable with a corresponding respective one of the n number of leads 256–262. For example, the first tandem switch 264 has a first n number of connector terminals 268. Each of these n connector terminals is shown connected to a respective one of the n leads 256. Likewise, the leads 258 extend to a second n number of connector terminals 270 of the first tandem switch 264. The leads 260 are connected to an n number of connector terminals 272 of the second tandem switch 266, and the leads 262 are connected to an n number of connector terminals 274 of the second tandem switch 266.

It is to be noted that the connector terminals 270 are disposed in reverse order with respect to the connector terminals 268 so that the first terminal of the connector terminals 268 is opposite the nth terminal of the connector terminals 270 and further so that the nth terminal of the connector terminals 268 is opposite the first terminal of the connector terminals 270. The connector terminals 274 are similarly disposed with respect to the connector terminals 272. This reverse positioning is best illustrated by the numbering of the connector terminals shown in FIGS. 1–7. This disposition of the connector terminals is made so that the appropriate tapped sections of the windings can be interconnected as each of the connector means of the two tandem switches is linearly moved along the support means of the respective switch. This type of disposition and interconnection is useful when the present invention is to be used with a transformer of the type disclosed in U.S. Pat. No. 4,160,224, for example.

FIG. 8B, which omits the leads 256–262 for purposes of simplicity, schematically discloses that the movement means of the first tandem switch 264 includes first conversion means for converting rotary motion into first linear motion. The first conversion means includes a first shaft 278 having a first axis of rotation 280. The first movement means also includes first crank means 282 rotatably disposed on a second axis 284 of rotation which is different from the first axis 280 of rotation. The first crank means is used for rotating the first shaft 278 about the first axis of rotation.

The second tandem switch 266 includes a second movement means comprising a second conversion means for converting rotary motion into second linear motion. The second conversion means includes a second shaft 288 having a third axis of rotation 290. The second movement means further includes second crank means 292 for rotating the second shaft 288 about the third axis of rotation 290. The second crank means 292 is rotatably disposed on a fourth axis of rotation 294 which is different from the third axis of rotation 290.

The shafts 278 and 288 are used in the preferred embodiment to retain the tandem switches in the housing 267 as indicated by the extensions of the shafts toward the top of FIG. 8B, which extensions continue to suitable rotative supporting engagement with the housing 267; however, other suitable means can be used for mounting the switches in the housing.

To enable the first crank means 282 to properly rotate the first shaft 278 despite the skewed axes of rotation 280 and 284, the first movement means also includes a universal joint 296 for coupling the first crank means 282 with the shaft 278. The second movement means similarly includes a universal joint 298 for coupling the second crank means 292 with the shaft 288.

In another embodiment, the first crank means 282 and the second crank means 292 can be disposed for rotation about the same axes of rotation as the shafts 278 and 288, respectively. This is illustrated in FIG. 8B by the phantom line extensions from the shafts 278 and 288. This construction obviates the need for the universal joints 296 and 298.

As further illustrated in FIG. 8B, the first conversion means includes sprocket wheels 300, 302, and the second conversion means 286 includes sprocket wheels 304, 306. Both of the sprocket wheels 300 and 304 are supported by the shaft 278, and both of the sprocket wheels 302 and 306 are supported by the shaft 288. The shaft 278 is fixedly connected to the sprocket wheel 300 so that the sprocket wheel 300 rotates when the shaft 278 rotates; however, the sprocket wheel 304 is mounted by suitable rotatably supporting means on the shaft 278 so that the shaft 278 supports, but does not rotate, the sprocket wheel 304. Likewise, the sprocket wheel 306 is appropriately connected to the shaft 288 so that both rotate together; however, the sprocket wheel 302 is mounted on the shaft 288 by suitable means for rotatably supporting the sprocket wheel 302 thereon so that the sprocket wheel 302 does not rotate when the shaft 288 rotates.

Figure 10:
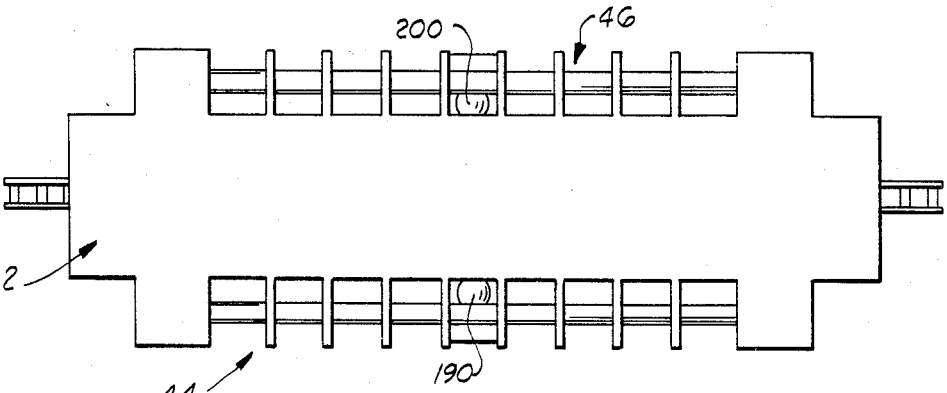
FIG. 10 is a bottom plan view of the second preferred embodiment.
Figure 11:
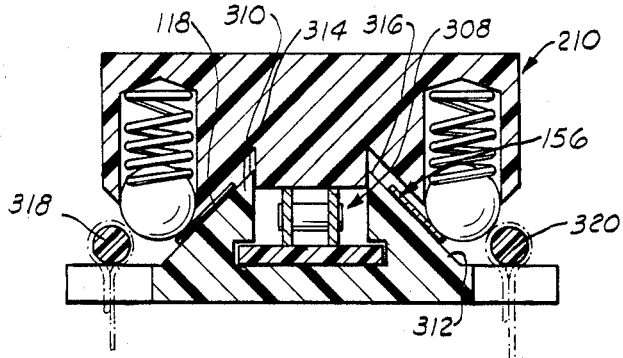
FIG. 11 is a sectional end elevational view of the second preferred embodiment taken along line 11—11 shown in FIG. 9.

With reference to FIGS. 9–11, a second preferred embodiment of the present invention will be briefly described. The second preferred embodiment has elements similar to those shown in FIGS. 1–7 as indicated by like reference numerals. However, the second preferred embodiment is constructed of plastic so that the support means 2 is unistructural. Of course, either embodiment may be made of any suitable material. Additionally, the support means 2 is formed so that it has a T-shaped channel 308 defined therethrough. The T-shaped channel 308 receives a complementally formed portion of the housing 210.

The T-shaped channel 308 is defined by portions 310 and 312 of the support means 2. The portions 310, 312 have beveled edges 314, 316, respectively, on which flat conductors constituting the second preferred embodiment of the common terminals 118, 156 are retained.

Still another distinction between the two preferred embodiments is the particular disposition of the terminal rods 318, 320 (note FIG. 11) relative to the remainder of the supporting means 2.

Other structural or design distinctions between the two preferred embodiments may be observed from FIGS. 9–11; however, the principal construction and operation of the second preferred embodiment is similar to that of the first preferred embodiment.

Therefore, the present invention is well adapted to carry out the objects and attain the ends and advantages mentioned above as well as those inherent therein. While preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A switch, comprising:

support means, including:

a first plurality of connector terminals linearly disposed along a first side of said support means; and a second plurality of connector terminals, in parallel relationship with said first plurality of connector terminals, linearly disposed along a second side of said support means so that each of said second plurality of connector terminals is aligned with a respective one of said first plurality of connector terminals;

a first common terminal, disposed on said support means and spaced from said first plurality of connector terminals, including a first elongated electrical conductor extending parallel to said first plurality of connector terminals;

a second common terminal, disposed on said support means and spaced from said second plurality of connector terminals, including a second elongated electrical conductor extending parallel to said second plurality of connector terminals;

connector means for electrically connecting a selected one of said first plurality of connector terminals to said first common terminal and for electrically connecting a selected one of said second plurality of connector terminals to said second common terminal; and movement means for selectively moving said connector means.

2. A switch as defined in claim 1, wherein said support means further includes:

a first plurality of connector receiving means for receiving said connector means in electrical communication with said first plurality of connector terminals and said first common terminal, each of said first plurality of connector receiving means being disposed between a respective one of said first plurality of connector terminals and a respective portion of said first elongated electrical conductor;

a second plurality of connector receiving means for receiving said connector means in electrical communication with said second plurality of connector terminals and said second common terminal, each of said second plurality of connector receiving means being disposed between a respective one of said second plurality of connector terminals and a respective portion of said second elongated electrical conductor;

a first plurality of connector engaging means for engaging said connector means and moving said connector means out of electrical communication with said first plurality of connector terminals and said first common terminal, each of said first plurality of connector engaging means being disposed between a respective adjacent pair of said first plurality of connector receiving means; and a second plurality of connector engaging means for engaging said connector means and moving said connector means out of electrical communication with said second plurality of connector terminals and said second common terminal, each of said second plurality of connector engaging means being disposed between a respective adjacent pair of said second plurality of connector receiving means.

3. A switch as defined in claim 2, wherein:

said movement means includes:

a housing having a first opening and a second opening defined therein; and means for retaining said housing in slidable engagement with said support means; and said connector means includes:

a first electrically conductive member disposed in said first opening of said housing;

first biasing means, disposed in said first opening of said housing, for biasing said first electrically conductive member toward a first path of travel defined by said first plurality of connector receiving means and said first plurality of connector engaging means;

a second electrically conductive member disposed in said second opening of said housing; and second biasing means, disposed in said second opening of said housing, for biasing said second electrically conductive member toward a second path defined by said second plurality of connector receiving means and said second plurality of connector engaging means.

4. A switch as defined in claim 3, wherein:

means for converting rotary motion into linear motion; and means for coupling said converting means to said housing.

5. A switch, comprising:

support means, including:

a first plurality of connector terminals; and a second plurality of connector terminals in parallel relationship with said first plurality of connector terminals;

a first common terminal disposed on said support means and spaced from said first plurality of connector terminals;

a second common terminal disposed on said support means and spaced from said second plurality of connector terminals;

connector means for electrically connecting a selected one of said first plurality of connector terminals to said first common terminal and for electrically connecting a selected one of said second plurality of connector terminals to said second common terminal;

movement means for selectively moving said connector means; and said support means further including:

a first plurality of connector receiving means disposed between said first plurality of connector terminals and said first common terminal so that when said connector means is received by one of said first connector receiving means, said connector means provides an electrical path between a respective one of said first plurality of connector terminals and said first common terminal;

a second plurality of connector receiving means disposed between said second plurality of connector terminals and said second common terminal so that when said connector means is received by one of said second connector receiving means, said connector means provides an electrical path between a respective one of said second plurality of connector terminals and said second common terminal;

a first plurality of connector engaging means disposed between adjacent ones of said first connector receiving means and offset from said first plurality of connector terminals so that when said connector means engages one of said first connector engaging means, said connector means is moved away from said first plurality of connector terminals and said first common terminal whereby no electrical path is provided between said first plurality of connector terminals and said first common terminal or between adjacent ones of said first plurality of connector terminals; and a second plurality of connector engaging means disposed between adjacent ones of said second connector receiving means and offset from said second plurality of connector terminals so that when said connector means engages one of said second connector engaging means, said connector means is moved away from said second plurality of connector terminals whereby no electrical path is provided between said second plurality of connector terminals and said second common terminal or between adjacent ones of said second plurality of connector terminals.

6. A switch, comprising:

support means, including:

a first plurality of connector terminals; and a second plurality of connector terminals in parallel relationship with said first plurality of connector terminals;

a first common terminal disposed on said support means and spaced from said first plurality of terminals;

a second common terminal disposed on said support means and spaced from said second plurality of terminals;

connector means for electrically connecting a selected one of said first plurality of connector terminals to said first common terminal and for electrically connecting a selected one of said second plurality of connector terminals to said second common terminal; and movement means for selectively moving said connector means, said movement means including:

a housing having a first opening and a second opening defined therein; and means for retaining said housing in slidable engagement with said support means;

said connector means including:

a first electrically conductive member disposed in said first opening of said housing;

first biasing means for biasing said first electrically conductive member toward engagement with said first plurality of connector terminals and said first common terminal;

a second electrically conductive member disposed in said second opening of said housing; and second biasing means, for biasing said second electrically conductive member toward engagement with said second plurality of connector terminals and said second common terminal; and said movement means further including means for linearly moving said housing along said support means so that said first electrically conductive member and said second electrically conductive member concurrently engage consecutive ones of said first plurality of connector terminals and said second plurality of connector terminals, respectively, as said housing is moved along said support means.

7. A compound tandem switching apparatus for interconnecting selectable ones of a plurality of tapped sections of a plurality of windings of a transformer, said apparatus comprising:

a first linear tandem switch, including:

a first plurality of linearly arrayed connector terminals;

a second plurality of linearly arrayed connector terminals;

a first common terminal;

a second common terminal;

a first connector means for establishing a first electrically conductive path between a selected one of said first plurality of connector terminals and said first common terminals and for concurrently establishing a second electrically conductive path between a selected one of said second plurality of connector terminals and said second common terminal; and first movement means for linearly moving said first connector means to selected ones of said first plurality of connector terminals and said second plurality of connector terminals; and a second linear tandem switch, associated with said first linear tandem switch, said second switch including:

a third plurality of linearly arrayed connector terminals;

a fourth plurality of linearly arrayed connector terminals;

a third common terminal;

a fourth common terminal;

second connector means for establishing a third electrically conductive path between a selected one of said third plurality of connector terminals and said third common terminal and for concurrently establishing a fourth electrically conductive path between a selected one of said fourth plurality of connector terminals and said fourth common terminal; and second movement means for linearly moving said second connector means to selected ones of said third plurality of connector terminals and said fourth plurality of connector terminals.

8. An apparatus as defined in claim 7, wherein:

said first plurality of connector terminals includes n terminals, each of which is connectable with a corresponding respective one of n leads from the tapped sections of a first one of said plurality of windings;

said second plurality of connector terminals includes n terminals, each of which is connectable with a corresponding respective one of n leads from the tapped sections of a second one of said plurality of windings, the n terminals of said second plurality of connector terminals being disposed in reverse order with respect to the n terminals of said first plurality of connector terminals so that the first terminal of said first plurality of connector terminals is opposite the nth terminal of said second plurality of connector terminals and the nth terminal of said first plurality of connector terminals is opposite the first terminal of said second plurality of connector terminals;

said third plurality of connector terminals includes n terminals, each of which is connectable with a corresponding respective one of n leads from the tapped sections of a third one of said plurality of windings; and said fourth plurality of connector terminals includes n terminals, each of which is connectable with a corresponding respective one of n leads from the tapped sections of a fourth one of said plurality of windings, the n terminals of said fourth plurality of connector terminals being disposed in reverse order with respect to the n terminals of said third plurality of connector terminals so that the first terminal of said third plurality of connector terminals is opposite the nth terminal of said fourth plurality of connector terminals and the nth terminal of said third plurality of connector terminals is opposite the first terminal of said fourth plurality of connector terminals.

9. An apparatus as defined in claim 8, wherein:

said first movement means includes:

first conversion means for converting rotary motion into first linear motion, said first conversion means including a first shaft having a first axis of rotation;

means for coupling said first linear motion to said first connector means; and first crank means, rotatably disposed on a second axis of rotation which is different from said first axis of rotation, for rotating said first shaft about said first axis of rotation; and said second movement means includes:

second conversion means for converting rotary motion into second linear motion, said second conversion means including a second shaft having a third axis of rotation;

means for coupling said second linear motion to said second connector means; and second crank means, rotatably disposed on a fourth axis of rotation which is different from said third axis of rotation, for rotating said second shaft about said third axis of rotation.

10. An apparatus as defined in claim 9, wherein:

said first movement means further includes means for rotatably supporting said first conversion means on said second shaft; and said second movement means further includes means for rotatably supporting said second conversion means on said first shaft.

11. An apparatus as defined in claim 7, wherein:

said first movement means includes:

first conversion means for converting rotary motion into first linear motion, said first conversion means including a first shaft having a first axis of rotation;

means for coupling said first linear motion to said first connector means; and first crank means, rotatably disposed on a second axis of rotation which is different from said first axis of rotation, for rotating said first shaft about said first axis of rotation; and said second movement means includes:

second conversion means for converting rotary motion into second linear motion, said second conversion means including a second shaft having a third axis of rotation;

means for coupling said second linear motion to said second connector means; and second crank means, rotatably disposed on a fourth axis of rotation which is different from said third axis of rotation, for rotating said second shaft about said third axis of rotation.

12. An apparatus as defined in claim 11, wherein:

said first movement means further includes means for rotatably supporting said first conversion means on said second shaft; and said second movement means further includes means for rotatably supporting said second conversion means on said first shaft.

13. A switch, comprising:

support means, including:

a first plurality of connector terminals; and a second plurality of connector terminals in parallel relationship with said first plurality of connector terminals;

a first common terminal disposed on said support means and spaced from said first plurality of terminals;

a second common terminal disposed on said support means and spaced from said second plurality of terminals;

connector means for electrically connecting a selected one of said first plurality of connector terminals to said first common terminal and for electrically connecting a selected one of said second plurality of connector terminals to said second common terminal; and movement means for selectively moving said connector means, said movement means including:

a housing; and means for slidably retaining said housing on said support means;

wherein said support means further includes:

a first plurality of connector receiving means disposed between said first plurality of connector terminals and said first common terminal so that when said connector means is received by one of said first connector receiving means said connector means provides an electrical path between a respective one of said first plurality of connector terminals and said first common terminal, said first plurality of connector receiving means including a first plurality of openings defined in said support means;

a second plurality of connector receiving means disposed between said second plurality of connector terminals and said second common terminal so that when said connector means is received by one of said second connector receiving means, said connector means provides an electrical path between a respective one of said second plurality of connector terminals and said second common terminal, said second plurality of connector receiving means including a second plurality of openings defined in said support means;

a first plurality of connector engaging means disposed between adjacent ones of said first connector receiving means and offset from said first plurality of connector terminals so that when said connector means engages one of said first connector engaging means, said connector means is moved away from said first plurality of connector terminals and said first common terminal whereby no electrical path is provided between said first plurality of connector terminals and said first common terminal or between adjacent ones of said first plurality of connector terminals; and a second plurality of connector engaging means disposed between adjacent ones of said second connector receiving means and offset from said second plurality of connector terminals so that when said connector means engages one of said second connector engaging means, said connector means is moved away from said second plurality of connector terminals whereby no electrical path is provided between said second plurality of connector terminals and said second common terminal or between adjacent ones of said second plurality of connector terminals;

wherein said connector means includes:

a first electrically conductive member disposed in said housing;

first biasing means for biasing said first electrically conductive member into said first plurality of openings;

a second electrically conductive member disposed in said housing; and second biasing means for biasing said second electrically conductive member into said second plurality of openings;

wherein said first plurality of connector engaging means includes a first plurality of wall means for urging said first electrically conductive member against said first biasing means, each wall means being disposed between adjacent ones of said first plurality of openings thereby defining side boundaries of said first openings; and wherein said second plurality of connector engaging means includes a second plurality of wall means for urging said second electrically conductive member against said second biasing means, each of said second plurality of wall means being disposed between adjacent ones of said second plurality of openings thereby defining side boundaries of said second openings.

14. A switch, comprising:

support means, including a plurality of connector terminals;

a common terminal disposed on said support means and spaced from said plurality of connector terminals;

connector means for electrically connecting a selected one of said plurality of connector terminals to said common terminal; and movement means for selectively moving said connector means, said movement means including:

a housing; and means for slidably retaining said housing on said support means;

wherein said support means further includes:

a plurality of connector receiving means disposed between said plurality of connector terminals and said common terminal so that when said connector means is received by one of said connector receiving means, said connector means provides an electrical path between a respective one of said plurality of connector terminals and said common terminal, said plurality of connector receiving means including a plurality of openings defined in said support means; and a plurality of connector engaging means disposed between adjacent ones of said connector receiving means and offset from said plurality of connector terminals so that when said connector means engages one of said connector engaging means, said connector means is moved away from said plurality of connector terminals and said common terminal whereby no electrical path is provided between said plurality of connector terminals and said common terminal or between adjacent ones of said plurality of connector terminals;

wherein said connector means includes:

an electrically conductive member disposed in said housing; and biasing means for biasing said electrically conductive member into said plurality of openings; and wherein said plurality of connector engaging means includes a plurality of wall means for urging said electrically conductive member against said biasing means, each wall means being disposed between adjacent ones of said plurality of openings thereby defining side boundaries of said openings.

* * * * *

UNITED STATES PATENT AND TRADEMARK OFFICE

CERTIFICATE OF CORRECTION

PATENT NO. : 4,514,602

DATED : April 30, 1985

INVENTOR(S) : Donald W. Owen

It is certified that error appears in the above-identified patent and that said Letters Patent are hereby corrected as shown below:

Column 1, line 60, change "switchig" to --switching--.

Column 1, line 62, change "these" to --those--.

Column 7, line 47, change "coactig" to --coacting--.

Column 16, line 62 (claim 13, line 29), between "means" and "said" insert --,--.

Signed and Sealed this

*Twenty-seventh* Day of *August 1985*

[SEAL]

*Attest:*

DONALD J. QUIGG

*Attesting Officer*

*Acting Commissioner of Patents and Trademarks*